United States Patent [19]

Low

[11] Patent Number: 4,997,992

[45] Date of Patent: Mar. 5, 1991

[54] LOW DISTORTION CABLE

[76] Inventor: William E. Low, P.O. Box 3060, San Clemente, Calif. 92672

[21] Appl. No.: 371,044

[22] Filed: Jun. 26, 1989

[51] Int. Cl.[5] ..... H01B 11/00; H01B 7/02

[52] U.S. Cl. ..... 174/24; 174/25 G; 174/26 G; 174/113 C; 174/131 A; 174/116

[58] Field of Search ..... 174/24, 25 G, 26 G, 174/113 C, 131 A, 116

[56] References Cited

U.S. PATENT DOCUMENTS

| | | | |
|---|---|---|---|
| 240,108 | 4/1881 | Eaton | 174/116 |
| 1,654,508 | 12/1927 | Boggs | 174/131 A |
| 3,014,087 | 12/1961 | Kaplan | 174/113 C |
| 3,453,374 | 7/1969 | Natwick | 174/113 C |
| 3,603,718 | 9/1971 | Gedenk | 174/116 X |
| 3,644,659 | 2/1972 | Campbell | 174/113 C X |
| 4,461,923 | 7/1984 | Bogese, II. | 174/131 A |

FOREIGN PATENT DOCUMENTS

| | | | |
|---|---|---|---|
| 2177 | 7/1869 | United Kingdom | 174/116 |

*Primary Examiner*—Morris H. Nimmo
*Attorney, Agent, or Firm*—Robert B. Block

[57] ABSTRACT

A low distortion cable made of multi-strand conductors including a dielectric core, a plurality of conductive strands of solid cross-section wrapped around the core in a single layer and a plurality of dielectric spacer strands, at least one of which is interspersed between each adjacent one of said conductive strands to form therewith a single layer of alternating conductors and dielectrics about a core. The support for the conductive strands is only at the lines of contact with adjacent strands and the core. A dielectric insulatr surrounds and supports the layer of strands and core in a unitary assembly, the interstices between strands and dielectrics, where not in contact along lines of support, being filled with a dielectric gas, such as air.

13 Claims, 1 Drawing Sheet

LOW DISTORTION CABLE

TECHNICAL FIELD OF THE INVENTION

The present invention relates to improvements in cables for carrying electrical signals that minimize electric and magnetic interactions between strands. An example is given of its application to interconnect cables for use in audio applications for transferring low level signals between components and for transferring audio power signals between power amplifiers and speakers. The invention is also applicable to many other types of cables used for electrical signal transmission such as in radio-frequency, HF, VHF, UHF, radar, telephone and digital data link systems.

Cables generally comprise conductors made up on strands. "Strand", as used herein, is a single conductive element, isolated by the construction disclosed, from all other strands. "Conductor" in the broad sense of the present invention refers to a strand or to a segregated group of strands, which pass through a common electrical connection to form a unitary conductive circuit.

BACKGROUND OF THE INVENTION

One of the fundamental problems in cable design is skin-effect, a difference in electrical values encountered by a signal at different depths in a conductor, most notably resulting in power loss at high frequencies. While the problem of power loss due to skin-effect is minimal at audio frequencies, there are other problems that skin effect causes including changes in impedence and inductance throughout the cable so that different frequencies encounter different electrical values at different distances from the surface of a strand of each single conductor.

This means if a single strand is too large, skin-effect will cause different parts of a music signal to behave differently. One of the more pronounced effects is that the delicate high frequency information, the upper harmonics, become delayed in time from lower frequencies. To the ear, this means the sound is lacking in detail, is dull and is closed, not open, with a soundstage that is flat. While the energy is still there, and the frequency response has not been changed; the information content of the signal will have been changed in a way that makes it sound as though the midrange notes have lost detail, i.e., their upper harmonics.

One solution to avoid the problems caused by skin-effect is to use a single strand of copper which is just small enough to push the induced distortion caused by skin-effect out of the audio frequency range. The largest size of a strand for this purpose is about 24 awg (0.205 sq mm). However, the power transfer for a single strand of 24 awg wire is not adequate for many purposes.

There are formulas which are used to described the reduction in current and power density at greater distances from the surfaces of a conductor. However, these formulas, by themselves, do not accurately describe at what skin depth audible distortion begins. Conventional application of the skin depth formula for copper ($0.0661\ m\sqrt{f}$) yields a skin depth at 20,000 Hz of 0.467 mm which is almost one-half the diameter of an 18 gauge strand. Audible, empirical evidence shows that distortion begins at much lesser depths. The above formulas assume that a 63% reduction in current flow at the center of a conductor is acceptable, and that an 86% reduction in powder density at the center of the conductor is acceptable. Therefore, in order to provide both low resistance and low distortion, multistrand construction is necessary.

For use in certain applications, multi-strand cables of various special constructions have been developed in order to avoid power loss and phase shifts caused by skin-effect. However, the arrangements of multi-strand constructions and the materials employed have resulted in other interactions between the strands, and between the strands and the dielectrics used for support, or for other purposes. These interactions can cause phase and other distortions due to magnetic interactions between strands, inter-stand contact rectification and resistance, and energy exchanges with the supporting dielectrics.

Other problems of multi-strand construction have yet to be solved. In almost all bundles, a given strand is sometimes on the surface and sometimes on the inside of the bundle. Every time a strand leaves the surface and goes inside, some of the current (particularly the higher frequency energy), will jump to a new strand in order to stay on the surface so it may follow the path of lowest impedance. The contact between strands is less than perfect. No matter how pure the copper (for example), the surface of every strand is oxidized, and copper oxides are semiconductors. The point of contact between strands is actually a simple circuit that has capacitance, inductance, and diode rectification—contributing a host of problems. This happens thousands of times in such a cable, and is the mechanism which causes most of the hashy and gritty quality in many audio cables.

Consider the conventional litz multistrand bundle construction in which each wire is individually insulated to become what is called, "magnet wire". Part of the definition of litz is that these wires are arranged in such a geometry over a given length of cable that each strand spends an equal amount of time at the surface and on the inside of the bundle so that all strands should have the same electrical values. If some strands were always on the outside and others always on the inside, only the strands on the outside would provide the proper conducting path and all other strands would have a different property in their ability to carry the signal. By individually insulating the strands and arranging them in an equivalent geometry, as in litz, they all carry the same amount of power at a particular frequency. This conventional litz arrangement, using magnet wire (individually insulated strands), also solves the problem of distortion caused by signal crossing from one strand to another strand in order to follow the path of least resistance.

However, litz still leaves unsolved problems of magnetic interaction and dielectric energy exchange. Also, in certain applications litz presents a difficulty in having a group of insulated strands that need to be de-insulated before being attached to anything else, and there are also compromises to high quality conductive materials that result from the need to take off, not to mention to put on, the enamel or polyurethane coating that is used to individually insulate these strands. So, while litz has been an effective means for many years in dealing with some problems, it does not deal with the remainder of the problems completely and it does have its own costs, so to speak, in manufacturing and in applications.

Another problem is magnetic interaction. When a strand of copper carries a current it creates a magnetid field. When two strands carry the same current they generate two magnetic fields, which causes them to interact like two magnets. On a microscopic level, a stranded cable is actually modulated by the current going through the cable. The effect is somewhat like doppler or intermodulation distortion. The more powerful magnetic fields associated with the bass notes cause the greatest magnetic interaction, which in turn modulates the electrical characteristics of the cable which in turn modulates the higher frequencies. This is the primary reason why bi-wiring works. Speakers which use a single amplifier but have separate inputs for the bass and upper ranges are able to dramatically reduce this type of distortion. With these speakers, the cable going to the high frequency portion no longer carries the bass energy, this prevents the interaction of the magnetic fields associated with the bass notes from causing distortion to the higher frequencies.

Even if one could ensure absolute mechanical regidity in a stranded cable, the interaction between magnetic fields would still be a prime source of distortion. Much of the energy traveling through a cable is carried as magnetic fields. In most cables, the magnetic field of any given strand encounters a complex and changing series of interactions as it travels through a constantly changing magnetic environment. The magnetic field is modulated and the audio signal becomes confused and distorted.

The electrical behavior of the dielectric (insulating material) in each conductor is much more important with low level cables. Dielectric involvement, the way in which a particular material absorbs and releases energy, can have a profound effect on the musical naturalness of a signal. Dielectric constant, which is the most often quoted specification for an insulating material, is actually not very helpful in understanding the audible attributes of different materials. The coefficient of absorption gives a clearer picture but still does not tell the whole story.

The problem is that any insulating material next to a conductor acts like a capacitor which stores and later releases energy. This is true of circuit board materials, cables, resistors and of course capacitors. The ideal wire is one with no insulation except for air or a vacuum. When solid materials have to be used, they should be as electrically invisible as possible. The less energy it absorbs the better. It would be best if the energy which is absorbed stays absorbed (turned into heat), and the energy that does come back into the conductive strands should have minimal phase shift and not be frequency selective (all frequencies should experience the same behavior). The most common insulating materials are polyvinylchloride, polyethylene, polypropylene and teflon. These can be mixed with air (foamed) or applied in a way to maximize the amount of air around the metal strands. Which material is used and how it is applied will dramatically effect the performance of a low level cable but has yet to be optimized for the values of preserving the quality and original music information contained in audio signals. To date, there has not been an audio cable design which addresses and minimizes the effects of the above mentioned problems.

There is, therefore, a need for an improved low distortion cable.

SUMMARY OF THE INVENTION AND OBJECTS it is a general object of the present invention to provide a low distortion cable which will overcome the above limitations and disadvantages.

It is a further general object of the invention to provide a low distortion cable of the above character which has no possibility of wire strand to wire strand interconductance paths, much reduced magnetic interaction, and minimal dielectric interaction while maintaining truly equal signal paths on all wire strands with a satisfactory power handling capability.

The low distortion cable of the present invention is made possible by the realization that a cable of symmetric strand geometry can be made with solid materials wherein the structural support for the wire strands is reduced to lines of surface contact between each wire strand and a dielectric supports, i.e., a core, adjacent spacer strands, and a sheath or cover.

The present invention generally comprises a cable having at least one multi-strand conductor for carrying an electrical signal. The conductor includes a round core of dielectric insulating material extending from one end of the conductor to the other around which is wrapped a first set of strands of electrically conductive material and a second set of cylindrical strands of dielectric insulating material which are interlaced with the first set of strands in an alternating pattern in which each conductive strand is separated from its next adjacent conductive strand neighbor by one or more dielectric insulating strands. The sets of strands are wrapped helically about the core so that the dielectric strands provide lines of surface contact laterally supporting the conductive strands. The core provides lines of surface contact interiorly supporting both sets of strands. A dielectric sheath surrounds the conductive and dielectric strands to provide lines of surface contact exteriorly supporting both sets of strands.

In this construction, each conductive strand is positioned in an identical electrical environment as compared to other conductive strands while being isolated from its conductive neighbors. Also, each conductive strand is surrounded by a dielectric gas except for lateral, interior, and exterior lines of solid-to-solid surface contact and support by adjacent dielectric material of the core, sheath and neighbor stands. The present invention uses multiple strands in a way in which they cannot interact electrically or magnetically and are substantially bounded by air except for the lines of surface contact with supporting dielectric solids.

This minimizes the problem of the interaction between the current carrying strands and the non-conductive dielectric material around them by surrounding each conductive strand with a dielectric gas (air) except for the lines of support. For, the greater the proportion of air and the less direct contact between the current carrying strands and solid insulator, the less dielectric energy storage and interaction there will be between the electric fields and the supporting dielectrics. This is an additional benefit to the construction of this invention, in that there are only four lines of surface contact between a strand of conductive material and the four lines of support from the non-conductive materials that hold it in place.

These and other objects and features of of the invention will become apparent from the following detailed description and claims when taken with the appended drawings, of which:

DETAILED DESCRIPTION OF THE PREFERRED EMBODIMENTS

Figures 1, 2, 3, 4:
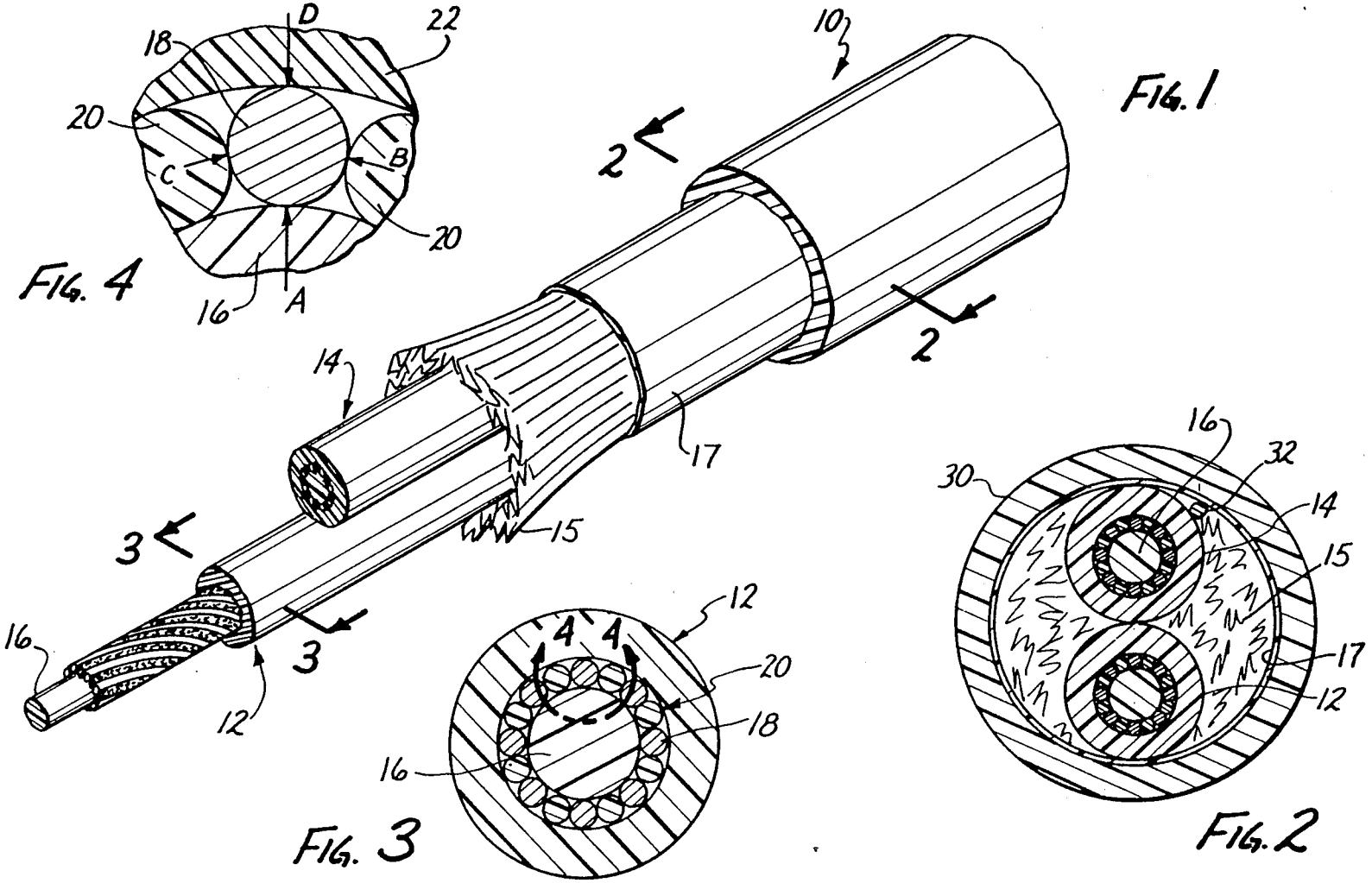
FIG. 1 is a perspective view of a low distortion two conductor cable constructed in accordance with the present invention.
FIG. 2 is a cross-sectional view taken along the lines 2—2 of FIG. 1.
FIG. 3 is a cross-sectional view taken along the lines 3—3 of FIG. 1.
FIG. 4 is a greatly enlarged cross-sectional view taken generally from the lines 4—4 of FIG. 3.

Referring to the drawings, there is shown a twin axial balanced cable 10 having two electrical conductors 12, 14 extending the length thereof from one end to the other. The conductors 12, 13 are supported in a bed of dielectric 15 fibers encased in a helically wrapped and overlapped metal foil 17 made of conductive material, all encased in a protection cover 30. A wire ground conductor 32 also extends the length of the cable from one end to the other and together with the foil provides a grounded shield which can be connected to earth ground, but are not used as part of the signal path, serving only as shielding and electrical reference. Each of the conductors are preferably identical in construction and is laid in a helical wrap within the bed of dielectric fibers. In FIG. 1 the conductors 12, 14 are shown extending from the cable as straigthened for the convenience of illustration although they are laid in a helical wrap of about one turn in 3 inches, of example, within the cable itself.

The conductors carry the positive and negative electrical signals respectively and are isolated from ground insofar as the cable construction is concerned. Each of the conductors 12, 14 is of the same construction as the other so that only one, 12 as shown in FIG. 3, need be described in detail.

Conductor 12 comprises a dielectric core 16, which may be round, and of solid or of solid foam construction surrounded by a helical wrap of a plurality of solid conductive strands 18 separated from each other by non-conductive or dielectric strands 20. The core may be of other cross-sectional shapes, such as star-shaped in cross-section (which may be formed by forming the core with longitudinal ridges), and still present a generally round outline on which to wrap the strands.

FIGS. 2 and 3 further illustrate the conductor construction in detail. Thus, as shown in this example, there are eight (8) conductive strands 18, each separated from the nearest neighboring conductive strand by a single dielectric strand 20 from the group of 8 dielectric strands so that there are 16 conductive and dielectric strands total.

In general, the conductor of the present invention is formed by always placing an equal number of one or more non-conductive strands 20 between each conductive strand 18 of the cable so that no conductive strand is adjacent or in contact with any other other conductive strand. It is really seen that this requirement is fulfilled with a total of $$m(n+1) \qquad (1)$$

strands to complete a conductor where m is the number of repeat units (2 or more) and n is the number of dielectric strands between each conductive strand. Thus, for the example shown m is 8 and $n=1$ so that the total number of individual strands is 16. At each end of the cable, all of the conductive strands of one conductor may be joined and connected to one terminal in a suitable connector, and the other conductive strands of the other conductor may be joined and connected to another terminal. The foil and ground are connected to a ground terminal.

FIGS. 3 and 4 show in detail how each of the conductive strands 18 in the conductors is bounded and supported. thus, each of strands 18 is supported interiorly on the helical line of contact between each strand and the non-conductive core (or by the points of the core, if the core is star-shaped), by the lines of contact between the adjacent strands, and by the line of contact between the inside of the cover dielectric and the strands. In other respects it is important that the strands are bounded only by air, or if desired or practical, by a gas such as nitrogen.

What this means then is that the conductive strands are as out of contact with dielectric material as possible even though their entire length is placed in as nearly electrically uniform and balanced a position with respect to the other conductive strands as possible (due to the helical turns of the strands and of the conductors themselves) and each is electrically isolated from the other strands for its entire length. The manner of support along the four lines of contact are best illustrated in the enlargement of the neighborhood of a single conductive strand shown in FIG. 4 wherein the line of contact with the core is labeled A, neighboring strands in contact at B and C, and contact with the cover 22 at D.

The conductive strands 18 can be made of any suitable conductive material which need be only more conductive, relatively, than the dielectric, non-conductive strands 20 for the given application. For audio cable applications, the conductive strands 18 may be made of bare copper wire.

Many dielectric materials are suitable for use as non-conductive strands 20 and as other dielectrics in the present invention. The following comprise a partial list of illustrative examples of cable material for this use: polyvinylchloride (PVC), polypropylene, polyethylene, foamed polyethylene, nylon, and teflon, to which may be added flexible ceramic fibers and flexible fiberglass strands. By way of example, the cable of the present invention may be made with any of the above dielectric materials of any combination of them.

The manner in which the present invention can be employed in specific multiconductor constructions can be varied widely. Thus, not only can one view the conductor shown in FIG. 3, for example, as an entity which may be terminated in a manner to provide a single conductor, as shown, but also a plurality of separate conductive paths for separate signals by connecting neighboring strands to different terminals.

To those skilled in the art to which this invention pertains, many modifications and adaptations will occur. "Conductive" and "dielectric" as used herein to describe electrical characteristics of strands should be taken in a broad sense in that a dielectric strand is at least less conductive than the conductive strand of the same conductor even though the strand used for a dielectric may itself be partially conductive or the conductive strand be partially dielectric in character.

And, while this disclosure of a preferred embodiment has shown a geometry based on the use of right circularly cylindrical elements, each in surface contact with the other along lines of support at the intersection of such surfaces, it should be understood that various substitutions can be made. For example, an additional layer of dielectric strands could be wound in the opposite direction before wrapping on the strands and wires of the conductive layer, and the result will be that the lines of contact will only exist for points where the strands/-wires of the conductive layer cross the additional layer in opposite directions so that the proximity of dielectric material in contact with bare conductors is reduced even further.

Also, while the present invention has been disclosed using conventional round geometries for the several parts, such as the core and the strands, it should be understood that these elements may be made oval, square, or in other cross-sectional shapes without departing from the teachings of the invention.

Accordingly, the scope of the present invention should be determined from that of the appended claims, and the details of the description of the preferred embodiments should not be taken in a limiting sense except where so claimed.

What is claimed is:

1. In a multistrand conductor, means forming a dielectric core, a plurality of bare conductive strands of solid cross-section wrapped around said core in a single layer, a plurality of dielectric spacer strands, at least one of which is interspersed between each adjacent one of said conductive strands to form therewith a single layer of alternating conductive strands and dielectric strands wrapped about said core, said dielectric core and said dielectric spacer strands being made of a material selected from the group consisting of solid plastic, foam plastic, solid plastic with ceramic fibers foam plastic with ceramic fibers, solid plastic with glass fibers and foam plastic with glass fibers, dielectric cover means for supporting said layer of strands and said core in an unitary conductor assembly, and a dielectric cover gas filling the interstices between said core, both said strands and said dielectric means.

2. The conductor as in claim 1 further in which said dielectric strands alternate one for one with said conductive strands.

3. The conductor as in claim 1 in which said conductive strands and said dielectric strands are of equal diameter.

4. The conductor as in claim 1 in which said strands are circularly cylindrical.

5. The conductor as in claim 1 wherein said conductive strands are bare metal wire.

6. The conductor as in claim 5 wherein said metal wire is made of copper.

7. A multistrand conductor for carrying an electrical signal comprising:

a core of dielectric insulating material extending from one end of the conductor to the other, a first set of strands made of electrically conductive material and of solid cross-section extending from one end of the conductor to the other, and surrounding said core for interior support thereon, a second set of strands made of dielectric insulating material extending from one end of the conductor to the other and interlaced with said first set of strands in an alternating pattern in which each conductive strand is separated from its next adjacent conductive strand neighbor by at least one dielectric insulating strand, said first and second sets of strands being wrapped helically about said core so that said second set of strands provides lines of surface contact to laterally support the conductive strands and said core provides at least points but no more than lines of surface contact interiorly supporting both sets of strands, said dielectric core and said dielectric spacer strands being made of a material selected from the group consisting of solid plastic, foam plastic, solid plastic with ceramic fibers from foam plastic with ceramic fibers, solid plastic with glass fibers and foam plastic with glass fibers, a dielectric insulator material surrounding said conductive and dielectric strands to provide at least point and no more than lines of surface contact exteriorly supporting the same so that each strand is positioned in an identical electrical environment as compared to other conductive strands while being isolated from each neighbor conductive strand, and a dielectric gas filling the interstices between the strands, the core, and the sheath so that each conductive strand surrounded by a dielectric gas except for said lateral, interior, and exterior points and lines of dielectric support.

8. The conductor as in claim 7 further in which said dielectric strands alternate one for one with said conductive strands.

9. The conductor as in claim 7 in which said strands are cylindrical and of equal diameter.

10. The conductor as in claim 7 in which said strands are circularly cylindrical.

11. A multistrand conductor for carrying an electrical signal comprising:

an elongate core of dielectric insulating material extending from one end of the conductor to the other, a first set of strands made of electrically conductive material of solid cross-section extending from one end of the conductor to the other, and surrounding said core for interior support thereon, a second set of strands made of dielectric insulating material extending from one end of the conductor to the other and interlaced with said first set of strands in an alternating pattern in which each conductive strand is separated from its next adjacent conductive strand neighbor by n dielectric insulating strands, where n is an integer greater than or equal to 1, said dielectric core and dielectric spacer strands being made of a material selected from the group consisting of solid plastic, foam plastic, solid plastic with ceramic fibers foam plastic with ceramic fibers, solid plastic with glass fibers and foam plastic with glass fibers, said first and second sets of strands being wrapped helically about said core so that said second set of strands provides (lines of lateral) line contact support for the conductive strands and said core provides (lines of interior) line contact support for both sets of strands, a dielectric insulator material surrounding said conductive and dielectric strands to provide (lines of exterior) line contact support to the same so that each strand is positioned in an identical electrical environment as compared to other conductive strands while being isolated from each neighbor conductive strand, a dielectric gas otherwise surrounding each conductive strand except for said lateral, interior, and exterior lines of dielectric support by said dielectric strands.

12. A multiconductor cable comprising at least two multistrand conductors, each of said conductors further comprising means forming a dielectric core, a plurality of bare conductive strands of solid cross-section wrapped around said core in a single layer, a plurality of dielectric spacer strands, at least one of which is interspersed between each adjacent one of said conductive strands to form therewith a single layer of alternating conductive strands and dielectric strands wrapped about said core, each of said dielectric cores and said dielectric spacer strands being made of a material selected from the group consisting of solid plastic, foam plastic, solid plastic with ceramic fibers foam plastic with ceramic fibers, solid plastic with glass fibers and foam plastic with glass fibers, dielectric cover means for supporting said layer of strands and said core in a unitary conductor assembly, and a dielectric gas filling the interstices between said core, both said strands and said dielectric means.

13. An electrical cable comprising at least two multistrand conductors, each of said conductors further comprising a core of dielectric insulating material extending from one end of the conductor to the other, a first set of strands made of electrically conductive material and of solid cross-section extending from one end of the conductor to the other, and surrounding said core for interior support thereon, a second set of strands made of dielectric insulating material extending from one end of the conductor to the other and interlaced with said first set of strands in an alternating pattern in which each conductive strand is separated from its next adjacent conductive strand neighbor by at least one dielectric insulating strand, said first and second sets of strands being wrapped helically about said core so that said second set of strands provides lines of surface contact to laterally support the conductive strands and said core provides at least points but no more than lines of surface contact interiorly supporting both sets of strands, each of said dielectric cores and said dielectric spacer strands being made of a material selected from the group consisting of solid plastic, foam plastic, solid plastic with ceramic fibers foam plastic with ceramic fibers, solid plastic with glass fibers and foam plastic with glass fibers, a dielectric insulator material surrounding said conductive and dielectric strands to provide at least point and no more than lines of surface contact exteriorly supporting the same so that each strand is positioned in an identical electrical environment as compared to other conductive strands while being isolated from each neighbor conductive strand, and a dielectric gas filling the interstices between the strands, the core, and the sheath so that each conductive strand surrounded by a dielectric gas except for said lateral, interior, and exterior points and lines of dielectric support.

* * * * *